US008098209B2

(12) United States Patent
van der Weide et al.

(10) Patent No.: US 8,098,209 B2
(45) **Date of Patent: *Jan. 17, 2012**

(54) SYSTEMS, METHODS AND DEVICES FOR IMPROVED IMAGING

(75) Inventors: Daniel van der Weide, Verona, WI (US); John Grade, Waunakee, WI (US)

(73) Assignee: Tera-X, LLC, Verona, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/848,421

(22) Filed: Aug. 2, 2010

(65) Prior Publication Data

US 2010/0315314 A1 Dec. 16, 2010

Related U.S. Application Data

(63) Continuation of application No. 12/116,666, filed on May 7, 2008, now Pat. No. 7,768,458.

(60) Provisional application No. 60/928,003, filed on May 7, 2007.

(51) Int. Cl.
*H01Q 3/36* (2006.01)

(52) U.S. Cl. ..... 343/853; 343/700 MS

(58) Field of Classification Search ..... 343/700, 343/725, 853, 876; 342/379
See application file for complete search history.

(56) References Cited

U.S. PATENT DOCUMENTS 3,659,227 A 4/1972 Whistler
3,887,925 A 6/1975 Ranghelli
5,138,323 A * 8/1992 Taylor, Jr. ..... 342/134
5,977,929 A * 11/1999 Ryken ..... 343/797
6,815,683 B2 11/2004 Federici
7,298,343 B2 11/2007 Forster
7,453,363 B2 11/2008 Reynolds
7,515,051 B2 4/2009 Wagner
7,643,869 B1 1/2010 Dabiri
7,768,458 B2 * 8/2010 van der Weide et al. ..... 343/700 MS
2008/0129641 A1 6/2008 Lee

OTHER PUBLICATIONS

Akkarackthalin, P., et al., "Distributed broadband frequency translator," presented at Microwave Symposium Digest, 1998 IEEE MTT-S International, 1998.
Cheville, R.A. and Grischkowsky, D., "Time domain terahertz impulse ranging studies," Applied Physics Letters, vol. 67, pp. 1960-1962, 1995.
Fattinger, C. and Grischkowsky, D., "Terahertz beams," Applied Physics Letters, vol. 54, pp. 490-492, 1989.
Grischkowsky, D., et al., "Far-infrared time-domain spectroscopy with terahertz beams of dielectrics and semiconductors," Journal of the Optical Society of America B, vol. 7, pp. 2006-2015, 1990.
Hagness, S.C., et al., "Three-dimensional FDTD analysis of a pulsed microwave confocal system for breast cancer detection: Design of an antenna-array element," IEEE Transactions on Antennas and Propagation, vol. 47, pp. 783-791, May 1999.
Herskovitz, D., "Wide, Wider, Widest," Microwave Journal, vol. 38, pp. 26-40, 1995.
Hu, B.B. and Nuss, M.C. "Imaging with terahertz waves," Optics Letters, vol. 20, pp. 1716-1718, Aug. 15, 1995.

(Continued)

*Primary Examiner* — Tho G Phan
(74) *Attorney, Agent, or Firm* — Casimir Jones S.C.

(57) ABSTRACT

The present invention provides devices, systems and methods for imaging and transmitting images. In particular, the present invention provides, systems, methods and devices for free-space polarization modulation.

18 Claims, 2 Drawing Sheets

1A

1B

OTHER PUBLICATIONS

Lee, K, et al., "Modeling and investigation of a geometrically complex UWB GPR antenna using FDTD," IEEE Trans. Antennas and Propagation, vol. 52, pp. 1983-1991, 2004.
Li, X, et al., "Numerical and experimental investigation of an ultrawideband ridged pyramidal-horn antenna with curved launching plane for pulse radiation," IEEE Antennas and Wireless Propagation Letters, vol. 2, pp. 259-262, 2003.
Van Der Weide, D.W., "Wideband terahertz sensing and spectroscopy with electronic sources and detectors," in Terahertz sources and systems, vol. 27, NATO Science Series, R. E. Miles, P. Harrison, and D. Lippens, Eds. Dordrecht, The Netherlands: Kluwer Academic Publishers, 2001, pp. 301-314.
Van Der Weide, D.W., et al., "Gas-absorption spectroscopy with electronic terahertz techniques," IEEE Transactions on Microwave Theory and Techniques, vol. 48, pp. 740-743, 2000.
Van Der Weide, D.W., et al., "Spectroscopy with electronic terahertz techniques," Proceedings of the SPIE The International Society for Optical Engineering, vol. 3828, pp. 276-284, 1999.
Van Exeter, M. and Grischkowsky, D., "Optical and electronic properties of doped silicon from 0.1 to 2 THz," Applied Physics Letters, vol. 56, pp. 1694-1696, 1990.
Van Exeter, M., "Terahertz time-domain spectroscopy of water vapor," Optics Letters, vol. 14, pp. 1128-1130, 1989.
Van Der Weide D.W., et al., "Picosecond dual-source interferometer extending Fourier-transform spectrometer to microwave regime," in 1996 IEEE MTT-S International Microwave Symposium Digest, vol. 3. New York, NY, USA: IEEE, 1996, pp. 1731-1734.
Van Der Weide, D.W., "Delta-doped Schottky diode nonlinear transmission lines for 480-fs, 3.5-V transients," Applied Physics Letters, vol. 65, pp. 881-883, 1994.
Van Der Weide, et al., "Electronic picosecond-pulse interferometer probing the millimeter-wave response of a quantum-dot system," presented at Quantum Optoelectronics, Dana Point, CA, 1995.
Li, et al., "Portable THz system and its applications," (1999), SPIE Proceedings, vol. 3616, pp. 126-135.
Hussain, M.A., "High frequency sparse array synthesis for target identification signatures," (2006), SPI Proceedings, vol. 6234, pp. 6234Y-1 to 6234Y-14.
Woodward, et al., "Terahertz pulse imaging of ex vivo Basal cell carcinoma," (2003), Journal of Investigative Dermatology, vol. 120, No. 1, pp. 72-78.
Federici, et al., "THz imaging and sensing for security applications—explosives, weapons, and drugs," (2005), Semiconductor Science and Technology, vol. 20, pp. S266-S280.
Choi, et al., "Potential for detection of explosive and biological hazads with electronic terahertz systems", (2004), Philosophical Transactions of the Yoral Society A, vol. 362, pp. 337-349.

* cited by examiner

1A

1B

SYSTEMS, METHODS AND DEVICES FOR IMPROVED IMAGING

CROSS-REFERENCE TO RELATED APPLICATION

The present invention is a continuation of allowed U.S. patent application Ser. No. 12/116,666, filed Aug. May 7, 2008, which will issue on Aug. 3, 2010 as U.S. Pat. No. 7,768,458, which claims priority to pending U.S. Provisional Application No. 60/928,003, filed May 7, 2007, entitled "Systems, Methods and Devices for Improved Imaging," both of which are herein incorporated by reference their entireties.

BACKGROUND

Improved antennas and related methods of imaging are needed.

SUMMARY

The present invention provides devices, systems and methods for imaging and transmitting images. In particular, the present invention provides, systems, methods and devices for free-space polarization modulation.

BRIEF DESCRIPTION OF THE DRAWINGS

FIG. 1A shows differentially driven antennas AD & BC, oriented at +/−45 degrees to x- and y-axis. As shown, simultaneous pulses create a virtual x-axis antenna along the dashed lines with +41% amplitude. FIG. 1B shows differentially driven antennas AD & BC, oriented at +/−45 degrees to x- and y-axis. As shown, alternating pulses create a virtual y-axis antenna along the dashed lines with +41% amplitude.

FIG. 2 shows that a delay change at input creates polarization change in free space which shows up as, for example, amplitude modulation at detector.

DETAILED DESCRIPTION

The present invention provides devices, systems and methods for imaging and transmitting images. In particular, the present invention provides, systems, methods and devices for free-space polarization modulation.

In some embodiments, the present invention provides systems and devices employing a plurality of antennas. The present invention is not limited to a particular type and/or kind of antennas. In some embodiments, the antennas are used for achieving enhanced imaging (e.g., better resolution and magnification).

In some embodiments, the invention provides a combination of two antennas (e.g., identical antennas). The present invention is not limited to a type of antenna. The present invention is not limited to a particular manner of combining the antennas. In some embodiments, the antennas are combined such that two identical antennas are arranged with the antennas radiating in the z direction with E-fields oriented at +/−45 degrees from the x-axis. In some embodiments, the antennas are oriented at 0 and 90 degrees such that a phase change to the physical antennas causes the antennas to be turned on or off, thereby allowing modification of individual pulses. In such embodiments, the combined antennas generate a far field radiation pattern that is equivalent to a single antenna with increased power (e.g., increased by 41%) oriented along either the x-axis (e.g., when the input waveforms are in phase) or the y-axis (e.g., when the input waveforms are 180 degrees out of phase).

In some embodiments, the phase in the physical antennas is adjusted to rotate the polarization of the synthesized antennas (at a single frequency) so as to allow a single antenna pair to interrogate a target over an entire polarization range. In some embodiments, depth ambiguity is accomplished through coded modulation of pulses, or groups of pulses. In some embodiments, depth of focus is determined via code length. In some embodiments, depth of field is determined through time shift between send and return correlation.

In some embodiments, when the input waveform is a step or pulse, a relative delay between the input waveforms is created such that the pulses or steps are either simultaneous or alternating, thus creating broadband radiation pulses that are aligned with the x- or y-axis, respectively. In some embodiments, the relative delay is accomplished by changing the relative phase of the input waveforms to a pair of nonlinear transmission lines.

Figure 1:
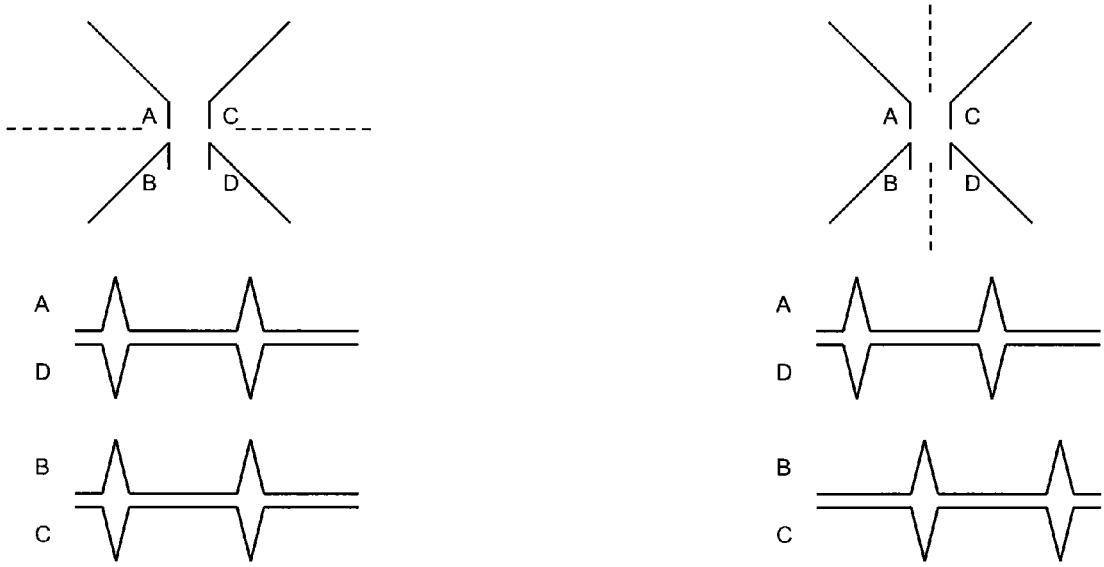
FIG. 1 shows an embodiment of the present invention.
Figure 2:
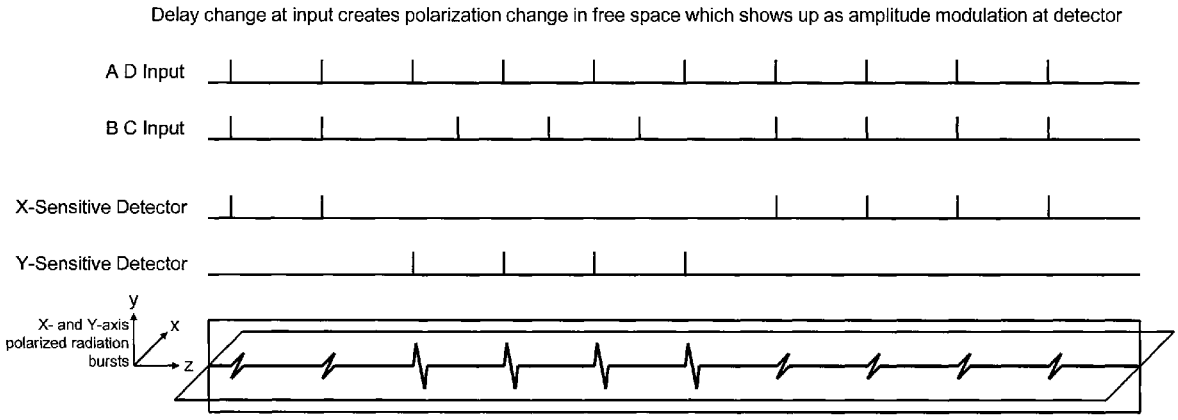
FIG. 2 shows an embodiment of the present invention. In particular.

FIGS. 1 and 2 show different embodiments of the present invention. The present invention is not limited to these embodiments.

In some embodiments, the present invention provides devices comprising one or more detectors that are sensitive to radiation polarized along an x-axis and/or y-axis. The present invention is not limited to a particular type or kind of detector. In some embodiments, the detector is configured to receive pulses created by simultaneous waveforms (e.g., along the x-axis). In some embodiments, the detector is configured to receive pulses created by alternating waveforms (e.g., along the y-axis). In some embodiments, the detectors of the present invention, through use of, for example, free-space polarization modulation, enable modulation of the detected amplitude of individual pulses (or groups of pulses) even though the generated pulses are all at constant amplitude.

In some embodiments, the present invention provides systems and methods for polarization coding. The present invention is not limited to particular systems or methods for polarization coding. In some embodiments, free-space polarization modulation is used to transmit information via a modulated signal (e.g., with a synthesized antenna described above). In some embodiments, such polarization modulation is only detectable using suitably polarized detectors of the present invention, and appearing as un-coded constant-amplitude pulses on any non-polarized detectors.

In some embodiments, the present invention provides systems and methods for transmitting coded information. The present invention is not limited to particular systems or methods for transmitting coded information. In some embodiments, free-space polarization modulation is used to transmit coded information such as, for example, a pseudo-random bitstream (PRBS) in order to filter out unwanted signals. In some embodiments, a filter (e.g., a PRBS filter) is used for time-gating in, for example, stand-off detection applications. In some embodiments, the time-gating reduces the impact of spurious signals from objects closer to or farther away from the target of interest and reducing the effect of multiple reflections.

The invention claimed is:

1. A device comprising two antennas, wherein said two antennas produce E-fields oriented at +/−45 degrees from the x-axis, wherein said two antennas generate a far field radiation pattern, and wherein said far field radiation pattern is oriented by controlling the phase of the input waveforms of said two antennas.

2. The device of claim 1, wherein polarization of said far field radiation pattern is oriented along either the x-axis or the y-axis.

3. The device of claim 2, wherein said far field radiation pattern is oriented along the x-axis when said input waveforms are in phase.

4. The device of claim 2, wherein said far field radiation pattern is oriented along the y-axis when said input waveforms are out of phase.

5. A method of generating aligned broadband radiation, comprising providing a device of claim 1, and creating a relative delay between input waveforms.

6. A system comprising the device of claim 1 and a device comprising one or more detectors configured to detect pulses created by the device of claim 1.

7. The device of claim 1, wherein said two antennas are identical or substantially identical.

8. The device of claim 1, wherein said antennas are oriented such that each of said antennas is radiating in the z direction.

9. the device of claim 1, wherein said far field radiation pattern has increased amplitude in comparison to the far field radiation pattern of a single antenna.

10. A device comprising two antennas, wherein said antennas are oriented such that each of said antennas is radiating in the z direction, wherein said two antennas generate a far field radiation pattern, and wherein said far field radiation pattern is oriented by controlling the phase of the input waveforms of said two antennas.

11. The device of claim 10, wherein polarization of said far field radiation pattern is oriented along either the x-axis or the y-axis.

12. The device of claim 11, wherein said far field radiation pattern is oriented along the x-axis when said input waveforms are in phase.

13. The device of claim 11, wherein said far field radiation pattern is oriented along the y-axis when said input waveforms are out of phase.

14. A method of generating aligned broadband radiation, comprising providing a device of claim 10, and creating a relative delay between input waveforms.

15. A system comprising the device of claim 10 and a device comprising one or more detectors configured to detect pulses created by the device of claim 10.

16. The device of claim 10, wherein said two antennas are identical or substantially identical.

17. The device of claim 10, wherein said two antennas produce E-fields oriented at +/−45 degrees from the x-axis.

18. the device of claim 10, wherein said far field radiation pattern has increased amplitude in comparison to the far field radiation pattern of a single antenna.

* * * * *